United States Patent [19]

Kurosawa et al.

[11] Patent Number: 4,481,880

[45] Date of Patent: Nov. 13, 1984

[54] DOT PRINTER

[75] Inventors: Makoto Kurosawa; Hiroshige Nakano; Kensei Hosoya; Tsuneki Kobayashi, all of Ibaraki, Japan

[73] Assignee: Hitachi Koki Company Limited, Tokyo, Japan

[21] Appl. No.: 484,693

[22] Filed: Apr. 19, 1983

Related U.S. Application Data

[63] Continuation of Ser. No. 291,719, Aug. 10, 1981, abandoned.

[30] Foreign Application Priority Data

Oct. 6, 1980 [JP] Japan ..... 55-140197

[51] Int. Cl.[3] ..... B41J 3/12

[52] U.S. Cl. ..... 101/93.04; 101/93.05; 400/121; 400/352

[58] Field of Search ..... 400/124, 121, 320, 352; 101/93.04, 93.05, 93.08, 93.15, 93.11, 93.09

[56] References Cited

U.S. PATENT DOCUMENTS 3,874,492 4/1975 Hurst ..... 101/93.05 X 3,941,051 3/1976 Barrus et al. ..... 400/121 X

OTHER PUBLICATIONS

IBM Technical Disclosure Bulletin, vol. 17, No. 12, May 1975, p. 3550.

*Primary Examiner*—Paul T. Sewell

*Attorney, Agent, or Firm*—Sughrue, Mion, Zinn, Macpeak & Seas

[57] ABSTRACT

A dot printer in which vibration is eliminated without the use of a separate counterweight. The printer includes first and second hammer banks each holding a plurality of dot printing elements. The first and second hammer banks are spaced apart from each other a predetermined distance in the direction in which a printing sheet passes. A motor and oppositely-phased drive cams reciprocate the two hammer banks in opposite directions parallel to a dot printing direction.

2 Claims, 4 Drawing Figures

DOT PRINTER

This application is a continuation of application Ser. No. 291,719, filed Aug. 10, 1981, abandoned.

BACKGROUND OF THE INVENTION

The present invention relates to a dot printer which prints characters with dot printing elements provided on printing hammers, as disclosed in U.S. Pat. No. 3,941,051, or with dot printing elements which are printing wires, as disclosed in U.S. Pat. No. 3,999,644.

The case where characters are printed with dot printing elements on printing hammers will be described. As shown in FIG. 1, dot printing element 2 secured in the upper end portions of printing hammers 1 are arranged in a single line parallel to a printing line. The lower end portions of the printing hammers 1 are secured to a hammer base 4 with fixing screws 3.

An example of a conventional dot printer is shown in FIG. 2. The printing hammers 1 are held in a hammer bank 5 through the hammer base 4. The hammer bank 5 is coupled to a drive motor 7 through a power conversion mechanism 6 including, for instance, a cam and a cam follower, so that the hammer bank 5 can be reciprocated along a printing line by the motor 7. An ink ribbon (not shown) and a printing sheet 8 are inserted between the dot printing elements 2 in the hammer bank 5 and a platen 11. The printing sheet 8 is fed by a tractor 9 which is driven by a sheet feeding motor 10.

As the hammer bank 5 is moved forwardly during reciprocation, dots in one horizontal line are printed by the dot printing elements 2 after which the printing sheet 8 is moved to the next dot printing line whereupon dots in that line are printed as the hammer bank 5 is moved backwardly, or returned. This operation is repeatedly carried out to print dots horizontally and vertically. That is, matrix characters are printed by reciprocating the hammer bank 5 parallel to a printing line and by stepping the printing sheet 8. When characters in one line have been printed, the printing sheet 8 is moved to the next printing line.

The printing speed of the dot printer of this type can be increased by employing a structure in which dot printing elements 2 are provided in the same number as there are positions and each dot printing element 2 prints a dot at the respective character column position. However, the provision of dot printing elements 2 and accordingly printing hammers 1 for each character column position involves the following drawbacks: If the printing hammers 1 are provided for each character column position, then it is necessary to provide an exciting device composed, for instance, of a permanent magnet and an electromagnetic coil for each character column position. This greatly increases the weights of the hammer bank 5 and the required capacity of the motor 7 making it difficult to reciprocate the hammer bank 5 at a high speed. As a consequence, it is impossible to increase the printing speed.

In order to overcome these drawbacks, another printer structure has been proposed in the art. In that printer, a dot printing element 2 is used to print dots at two or three character column positions so that the number of printing hammers 1 and exciting devices is decreased and accordingly the weight of the hammer bank 5 is decreased to thereby allow the hammer bank 5 to be reciprocated at a high speed and thereby increasing the printing speed.

However, that structure still involves the following drawbacks. If the hammer bank 5 is reciprocated at a high speed, then when the direction of movement of the hammer bank 5 is reversed, i.e. when the hammer bank 5 is returned, as the acceleration of the hammer bank 5 typically reaches 20 to 30 G, with a hammer bank 5 having a weight of 2 kg an inertial force of 40 to 60 kg is imposed. As a result, a high force is imparted to the printer itself in the direction of movement of the hammer bank 5 thus causing the printer to vibrate strongly.

In order to solve this problem, a technique has been proposed in which a counterweight is provided reciprocating in directions opposite to the directions of movement of the hammer bank 5 to cancel the aforementioned inertial force and thereby preventing vibration of the printer. However, that technique is also disadvantageous in that the counterweight is unnecessary to the basic function of the printer, and addition of such an unnecessary component increases the manufacturing cost and necessitates the use of a large capacity drive motor.

An object of the invention is thus to provide a dot printer in which all of the above-described drawbacks accompanying a conventional dot printer have been eliminated and which is simple in construction and is capable of operating at a high printing speed.

SUMMARY OF THE INVENTION

In accordance with these and other objects of the invention, there is provided a printer having two hammer banks, one above the other. The two hammer banks are reciprocated in opposite directions so that the hammer banks serve as counterweights to each other. Thereby, an additional counterweight is eliminated and the dot printer is made simple in construction and is capable of operating at a high speed.

DESCRIPTION OF THE PREFERRED EMBODIMENTS

Figure 1:
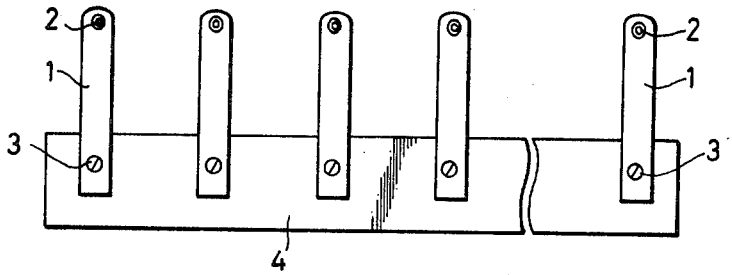
FIG. 1 is a front view of an example of an arrangement of printing hammers.
Figure 2:
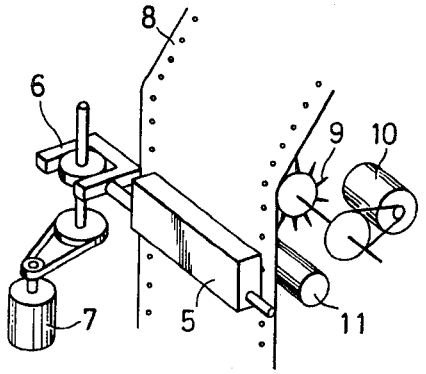
FIG. 2 PRIOR ART
FIGS. 2 and 3 are perspective views showing an example of a conventional dot printer and an example of a dot printer according to the invention, respectively.
Figure 3:
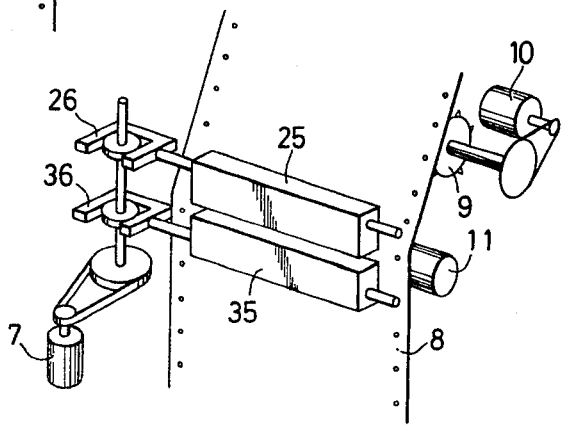

FIG. 3 shows an example of a dot printer constructed according to the invention. In FIGS. 3 and 2, like parts are designated by like reference numerals.

As shown in FIG. 3, hammer banks 25 and 35 are provided stacked vertically, that is, in the sheet feeding direction. The hammer banks 25 and 35 are coupled through respective power conversion mechanisms 26 and 36 to a common drive motor 7 so that the hammer banks 25 and 35 are reciprocated in opposite directions. An equal number of printing hammers 1 and accordingly dot printing elements 2 are contained in the hammer banks 25 and 35 so that the hammer banks 25 and 35 are equal in weight.

Figure 4:
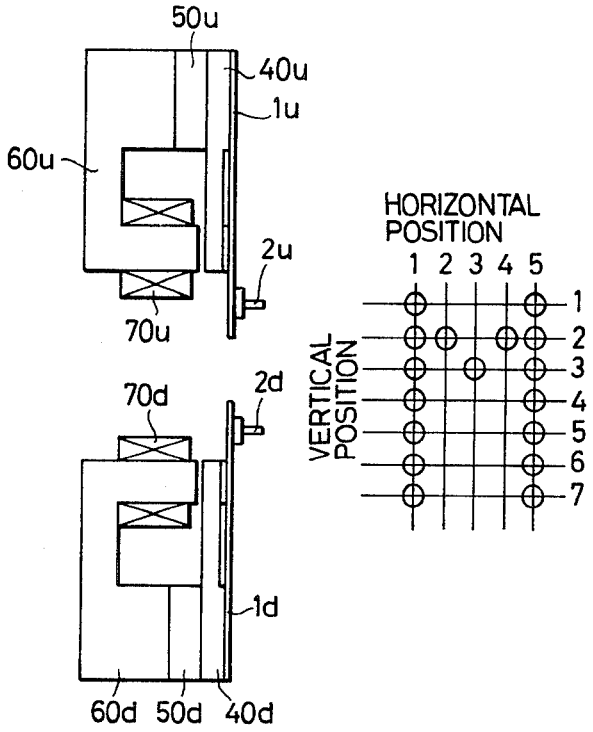
FIG. 4 shows side views of printing hammers and exciting devices therefor and a sample of a printed character, for a description of the operation of the dot printer according to the invention.

FIG. 4 is a diagram for a description of the printing operation of the dot printer according to the invention. More specifically, FIG. 4 shows the printing hammers 1 and the exciting devices therefor, and a sample of a character "M" which is printed with five dots in a horizontal direction and seven dots in a vertical direction.

The components of the upper hammer bank 25 and the components of the lower hammer bank 35 are designated by the reference numerals suffixed with "u" and "d", respectively. The upper and lower dot printing elements 2*u* and 2*d* are spaced from each other by a distance corresponding to four dot positions. While the dot printing elements 2*u* print dots at vertical dot positions 1, 2 and 3, the dot printing elements 2*d* print dots at vertical dot positions 5, 6 and 7. While the dot printing elements 2*u* print dots at vertical positions 4, the dot printing elements 2*d* do not carry out printing operation.

When the dot printing element 2*u* starts printing from a horizontal position 1 or 5, the dot printing element 2*d* starts printing from a horizontal position 5 or 1.

In FIG. 4, reference characters 40*u* and 40*d* designate yokes serving also as a hammer base 4, 50*u* and 50*d* permanent magnets for a attracting and retaining the printing hammer 1, 60*u* and 60*d* yokes forming magnetic circuits with the yokes 40*u* and 40*d*, and 70*u* and 70*d* an electromagnetic coils wound on the legs of the yokes 60*u* and 60*d*. The electromagnetic coils 70*u* and 70*d*, which operate to cancel the attractive force of the permanent magnets 50*u* and 50*d*, are excited when printing.

With the arrangement described above, a couple, which is the product of the distance between the centers of gravity of the upper and lower hammer banks 25 and 35 and the above-described inertial force, is imparted, as a vibrating force, to the printer. However, since the inertial moment of the printer itself is large and the distance between the centers of gravity is small, the vibrating force will not be so large that the printer is vibrated thereby.

As is apparent from the above description, according to the invention, it is unnecessary to provide a separate counterweight. Therefore, the dot printer of the invention is simple in construction and can be manufactured at a low cost. The upper and lower dot printing elements are used to print characters in one and the same line according to the invention, which remarkably improves the printing speed.

What is claimed is:

1. A dot printer comprising:

first and second hammer banks, each of said hammer banks comprising a plurality of printing hammers arranged in a dot printing direction at predetermined intervals, a plurality of dot printing elements, each of said dot printing elements being mounted on a tip of a corresponding one of said printing hammers, said dot printing elements of each of said hammer banks being arranged in a line parallel to a dot printing direction and perpendicular to a printing sheet feeding direction and extending along most of a width of a printing area of a printing sheet, said tips of said printing hammers of said first hammer bank being at a lower end of said printing hammers of said first hammer bank, said tips of said printing hammers of said second hammer bank being at an upper end of said printing hammers of said second hammer bank, and said first and second hammer banks being spaced a predetermined distance apart from one another in said printing sheet feeding direction such that said lines of said dot printing elements of said first and second hammer banks are spaced apart from one another by a distance less than a character format height; and driving means for reciprocating said two hammer banks oppositely in said dot printing direction through distances substantially less than lengths of said hammer banks in said printing direction to cause to said dot printing elements of said first and second hammer banks to simultaneously print characters in a single line.

2. The dot printer of claim 1 wherein said drive means comprises a drive motor; a drive shaft operatively coupled to be rotated by said drive motor; first and second eccentric cams coupled to be rotated by said drive shaft, said first and second drive cams being positioned on said drive shaft so as to rotate with opposite phases from one another; and first and second cam followers, said first cam follower coupling said first hammer bank to be reciprocated by said first cam and said second cam follower coupling said second hammer bank to be reciprocated by said second cam follower.

* * * * *